US005794797A

United States Patent [19]

Kuntz

[11] Patent Number: 5,794,797

[45] Date of Patent: Aug. 18, 1998

[54] DRYING DEVICE

[75] Inventor: William Kuntz, Ellicott City, Md.

[73] Assignee: Eagle Inventors, LLC, Ellicott City, Md.

[21] Appl. No.: 820,054

[22] Filed: Mar. 18, 1997

[51] Int. Cl.[6] ..... A47F 7/00

[52] U.S. Cl. ..... 211/41.3; 312/229

[58] Field of Search ..... 211/41.3, 41.4, 211/41.2, 62, 63; 312/229; D32/55

[56] References Cited

U.S. PATENT DOCUMENTS

| | | | |
|---|---|---|---|
| 124,085 | 2/1872 | Richmond | 211/41.3 |
| 542,912 | 7/1895 | Wood . | |
| 1,661,098 | 2/1928 | Side | 211/62 |
| 2,632,568 | 3/1953 | Abt | 211/41.3 |
| 2,692,790 | 10/1954 | Tharrington | 211/41.3 X |
| 2,936,898 | 5/1960 | Miguez . | |
| 3,952,875 | 4/1976 | Lombardo . | |
| 4,221,299 | 9/1980 | Taylor . | |
| 4,254,881 | 3/1981 | Hard . | |
| 4,480,343 | 11/1984 | Drach | 211/41.3 X |
| 4,756,582 | 7/1988 | Heien . | |
| 4,812,621 | 3/1989 | Brotherton et al. | 211/41.3 X |
| 4,884,714 | 12/1989 | Bechtel | 211/41.2 X |
| 4,969,560 | 11/1990 | Stanfield . | |
| 5,012,934 | 5/1991 | Newhall . | |
| 5,109,990 | 5/1992 | Murphy et al. . | |
| 5,158,184 | 10/1992 | Craft et al. . | |
| 5,184,749 | 2/1993 | Attenasio . | |
| 5,312,178 | 5/1994 | King | 312/229 X |
| 5,332,105 | 7/1994 | Stanfield . | |
| 5,460,276 | 10/1995 | McKeon et al. . | |
| 5,485,927 | 1/1996 | Hubbard . | |
| 5,547,087 | 8/1996 | Licari . | |

OTHER PUBLICATIONS

"Rubbermaid Consumer Services Catalog", Apr. 1996, pp. 1 and 13.

"Tucker Consumer Services Catalog", 1996, p. 19.

*Primary Examiner*—Robert W. Gibson, Jr.

*Attorney, Agent, or Firm*—Sterne, Kessler, Goldstein & Fox P.L.L.C.

[57] ABSTRACT

A compact drying device which requires little or no counter space. The drying device find a particular utility in apartments, mobile homes and all small kitchens with limited counterspace. The drying device may be attached to or hung from any wall or shelf, and the water dripping from the dishes and other utensils stored within or upon the device may be channeled to a drain using an extendable spout.

15 Claims, 6 Drawing Sheets

DRYING DEVICE

FIELD OF THE INVENTION

The present invention relates generally to a drying device, and more particularly to a compartment for storing, draining and drying kitchen utensils. The drying device is very compact and requires little or no counterspace. The drying device find a particular utility in apartments, townhomes, mobile homes and all small kitchens with limited counterspace. The drying device may be attached to or hung from any wall or shelf, and the water dripping from the dishes and other utensils stored in the device may be channeled to a drain using an extendable spout.

BACKGROUND OF THE INVENTION

Modem times have witnessed both an increase in the cost and a decrease in the availability of affordable, adequately-sized housing. Numerous factors, many interrelated, have contributed to this fact. For example, the cost of building supplies and scarcity of land have resulted in builders constructing homes having smaller scales. In addition, young adults are moving out of their families' homes at an increasingly early age. Conversely, older adults are living increasingly longer; such couples and surviving spouses often seek to downsize their living arrangements during their retirement years. All of the foregoing factors have contributed to an unprecedented number of people living in smaller dwellings. Accordingly, more and more people are turning to apartments, townhomes, condominiums, mobile homes, etc. as their primary means of residence.

As homes are becoming smaller, one of the first rooms in the home to suffer the effects of downsizing is often the kitchen. "Efficiency"-type units, wherein the kitchen contains a refrigerator, stove, cabinets and little else, are quite common. Many of these small kitchens do not include a dishwasher. Moreover, such kitchens usually contain very little counterspace. An obvious drawback of this lack of counterspace is that appliances and other objects which rest upon the counter take up the resident's limited space. This is particularly problematic in that today's increased materialism has resulted in individuals having an unprecedented amount of consumer goods. Accordingly, the need for efficient use of space in the home is at a premium. This is why appliances such as microwaves, toaster ovens, etc. are now manufactured which may be mounted to a wall or beneath a cabinet, thereby freeing up counterspace.

A vexing problem presented by "efficiency" kitchens, particularly by kitchens lacking a dishwasher, is where to store and dry pots, pans, plates, and other kitchen utensils. Conventional drying baskets or racks are placed and rest upon the kitchen counter. Such racks must traditionally be placed on the counter right next to the sink, so that the water dripping from the dishes can flow directly into the sink. This presents obvious drawbacks in light of the need to make efficient use of minimal space, as discussed above.

In light of the foregoing, the need exists for a drying device which will enable a homeowner or other resident to make maximum use of limited kitchen space.

It is, therefore, an object of the present invention to provide a drying device which will enable a homeowner or other resident to make maximum use of limited kitchen space.

It is a further object of the present invention to provide a drying device which does not require any counterspace.

It is a further object of the present invention to provide a portable drying device which is easily attached to shelves, window sills, walls, cabinets, etc.

It is a further object of the present invention to provide a drying device which provides for the relatively free circulation of air in order to expedite drying of all utensils stored therein.

It is a further object of the present invention to provide a drying device which has an extendable spout so that the device may be placed remote from a kitchen sink or other drain.

It is a further object of the present invention to provide a drying device having surfaces which may fold down for ease in cleaning.

It is a further object of the present invention to provide a drying device having partitions which protect items from damage, and which may fold down to increase the number and size of utensils which may be held by the device.

It is a further object of the present invention to provide a drying device which makes maximum use of its interior and exterior surfaces, in part by the provision of glass and cup holders, attachable silverware compartments, a knife chest, and a top surface upon which objects may be placed.

It is a further object of the present invention to provide a drying device having a simple, low-cost construction and made from a lightweight material.

SUMMARY OF THE INVENTION

To achieve the foregoing and other objects, and in accordance with the purposes of the present invention, as embodied and broadly described herein, the present invention comprises a drying device. The drying device includes a bottom surface, top surface, first sidewall and second sidewall. A partition is disposed between and substantially parallel to the first and second sidewalls. An extendable and retractable spout is disposed adjacent the bottom surface, and mounting structure is provided for mounting the drying device remote from a kitchen sink.

The partition may be formed of a partially latticed construction. The top surface may be slanted, and a plurality of retaining elements may be disposed on the top surface. The retaining elements may comprise raised dimples having holes formed therein.

A plurality of retaining spikes may be detachably secured to the drying device. A silverware compartment and/or a knife chest may also be detachably secured to the drying device. A slanted bearing surface formed partially of a latticed construction for supporting plates and other utensils may be disposed above the bottom surface. Hinged extensions may be disposed adjacent each side of the bottom surface. Second mounting structure comprising at least one cable secured to the first mounting structure may be provided.

The spout may be semi-circular or "gutter" shaped. A channel may be formed adjacent the center portion of the bottom surface, and the bottom surface may slope inwardly from its sides to its center portion such that water is channeled toward the spout.

BRIEF DESCRIPTION OF THE FIGURES

The accompanying drawings, which are incorporated in and form a part of the specification, illustrate an embodiment of the present invention and, together with the description, serve to explain the principles of the invention.

DETAILED DESCRIPTION OF THE PREFERRED EMBODIMENT

Reference will be made in detail below to the preferred embodiment of the present invention illustrated in the accompanying drawings. It should be noted that similar or identical structure is identified using reference numbers.

Figure 1:
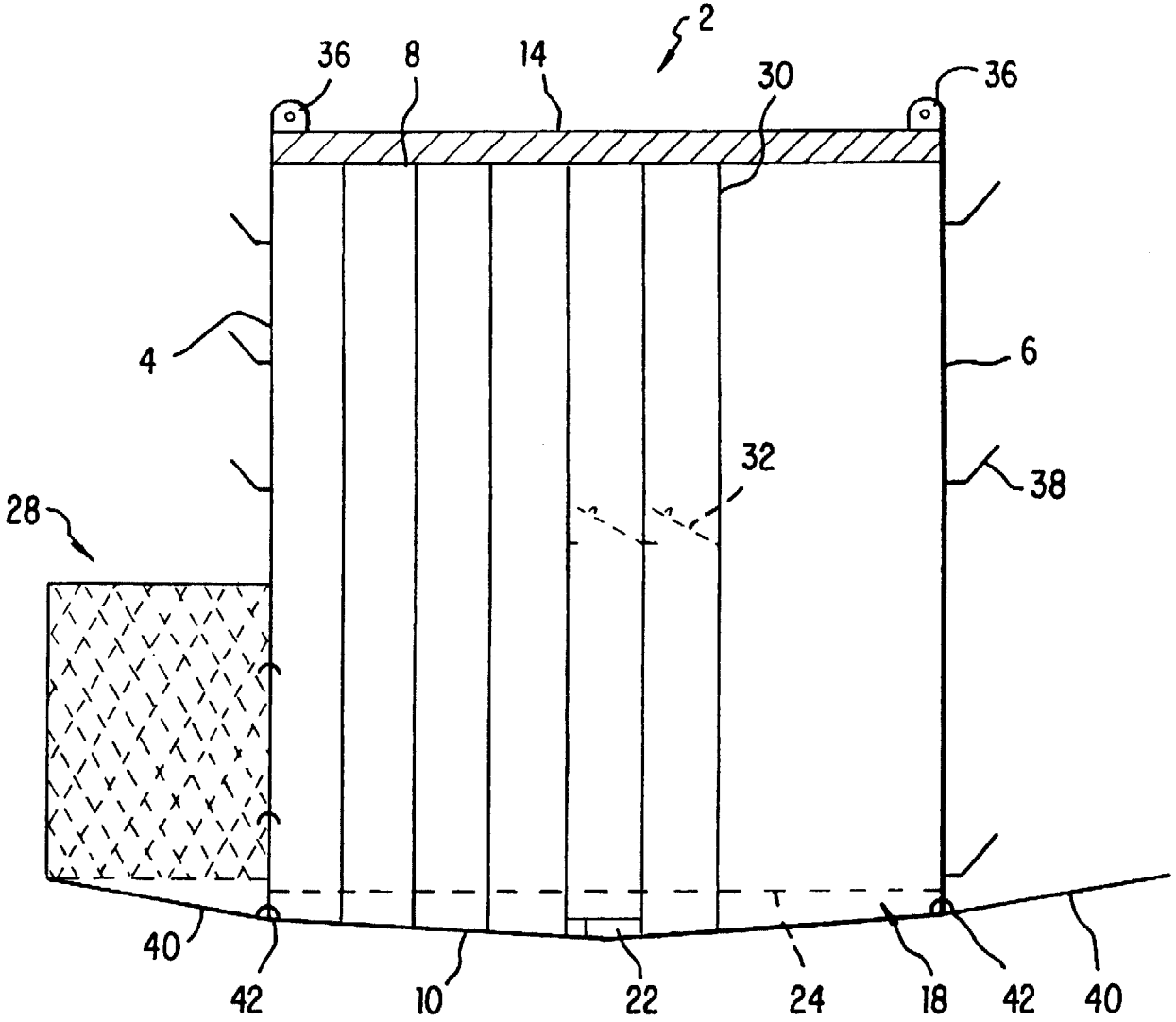
FIG. 1 is a front view of a drying device in accordance with the present invention.
Figure 2:
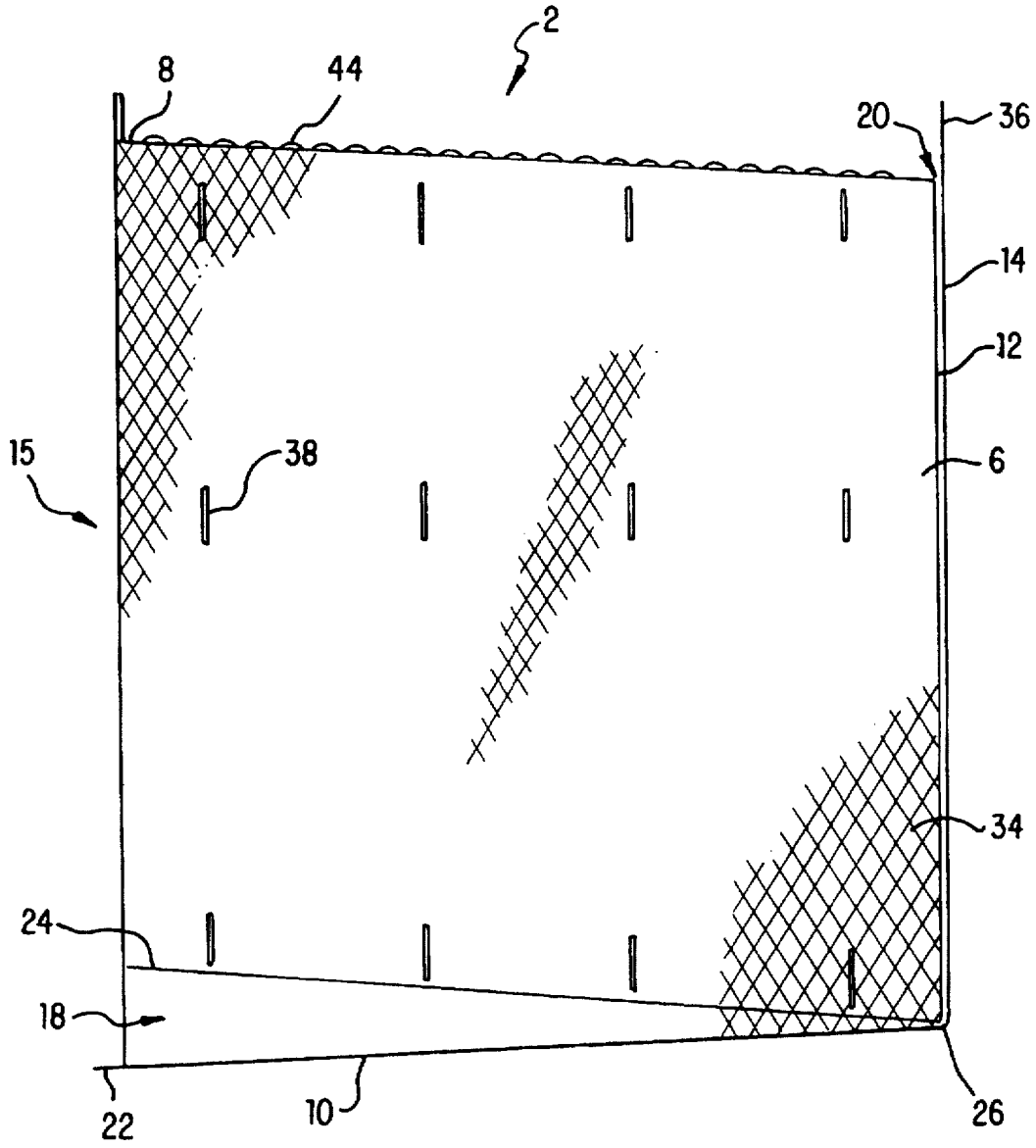
FIG. 2 is a left side view of a drying device in accordance with the present invention.

Referring now to the preferred embodiment, a drying device in accordance with the present invention is shown generally at 2 in FIGS. 1 and 2. Drying device 2 may be made of any low-cost, lightweight material. For example, conventional plastics, rubber or metal materials, or a combination thereof, may be used. Drying device 2 preferably comprises a substantially box-like structure defined by first sidewall 4, second sidewall 6, top surface 8, bottom surface 10, rear wall 12 and front opening 15. As shown in FIG. 2, a second rear wall 14 may be disposed behind and substantially parallel to rear wall 12, thereby creating a narrow rear drainage area 20 between rear wall 12 and second rear wall 14.

It is preferred that the walls and surfaces of drying device 2 be constructed such that relatively free circulation of air is provided and promoted throughout the device. In this regard, the first sidewall 4, second sidewall 6 and the interior rear wall 12 will be formed at least partially of a latticed or mesh-type construction (shown at 34 in FIG. 2). The exterior rear wall 14 is of a solid construction or material to prevent leakage on the household wall. The top panel ceiling 8 in FIG. 1, is also of a solid construction and includes a plurality of raised circular units 44, each with a hole in the center for air circulation (discussed below; see FIGS. 4 and 5). The latticed or mesh construction may comprise a relatively thin cloth or textile material which wicks away moisture and dries rapidly, thereby preventing mildew and other bacterial build-up. It will be appreciated that such a construction promotes air circulation and thus speeds up the drying process of plates and other utensils disposed within device 2.

As shown in FIG. 1, a plurality of partitions 30 are preferably disposed within drying device 2. Partitions 30 may be used to compartmentalize drying device 2, and individual items such as dishes and dinner plates may be placed between each pair of partitions 30. Partitions 30 thus enable dishes and other utensils to be stored in an orderly and efficient manner, while also protecting such items from damage such as scratching, cracking and breaking which may occur when such objects come into contact with one another.

It is preferred that partitions 30 comprise at least in part the latticed or mesh construction discussed above, in order to promote air circulation and speed the drying process. In this regard, it will be appreciated that air can circulate relatively freely between first sidewall 4 and second sidewall 6, even when a plurality of partitions 30 are disposed within drying device 2.

Although, as shown in FIG. 1, partitions 30 may extend throughout the height of drying device 2 (i.e., from bearing surface 24 (discussed below) to top surface 8), partitions 30 may instead have an abbreviated construction, such that they extend for only a portion of the height of drying device 2. In addition, as shown in FIG. 1, shelves 32 may be disposed on partitions 30. Shelves 32 may be used to further maximize the space within drying device 2, for example, when a large number of smaller utensils such as saucers or bowls need to be dried. Shelves 32 may be either detachable from partitions 30 or, alternatively, foldable thereon such that they may be placed flush with partitions 30 when not in use.

Similarly, it is preferred that partitions 30 themselves be removable from, and/or foldable within, drying device 2. In this manner, a user may implement any number of partitions 30 depending upon the number and size of utensils which drying device 2 is intended to hold. Such a removable and/or foldable construction will also foster the ease of cleaning drying device 2.

In light of the foregoing, it will be readily understood that, although six partitions 30 are shown in FIG. 1, any number of partitions 30 may be used, depending upon the needs of the user. For example, if a user wishes to dry a dozen large dinner plates, eleven partitions may be used. Conversely, if the user wishes to dry one large pot, no partitions need be used.

Partitions 30 are only one of several features which maximize the internal and external spaces of the drying device of the present invention, thereby permitting a user to dry many utensils in a compact space. For example, a plurality of hooks or spikes 38 may be disposed on first sidewall 4 and/or second sidewall 6 of drying device 2. Spikes 38 may be detachably secured to drying device 2, such as by a leg or hook which extends through a hole of the latticed or mesh construction of sidewalls 4, 6.

In addition, as shown in FIG. 1, a detachable compartment 28, such as for silverware, may be detachably secured to drying device 2. Compartment 28 may be attached to drying device 2 via legs or hooks which extend through the latticed or mesh construction of sidewalls 4, 6 thereof.

Assuming drying device 2 is not mounted such that top surface 8 is flush with another surface (such as the bottom of a cabinet), top surface 8 may also be used to retain a utensil for drying, such as a pot. In this regard, it is preferred that top surface 8 be made of a solid construction (as opposed to the latticed or mesh construction previously discussed), so that water dripping from an object on top surface 8 does not drip downwardly onto items stored and drying within the interior of drying device 2 below. As shown in FIG. 2, it is also preferred that top surface 8 be slanted slightly downwardly from front opening 15 to rear wall 12, so that water dripping from an object on top surface 8 will flow toward rear wall 12. Moreover, as shown in FIG. 2, a second rear wall 14 may be disposed behind and substantially parallel to rear wall 12. Second rear wall 14 defines in part a rear drainage area 20 which directs the water from top surface 8 toward bottom surface 10 of drying device 2. Second rear wall 14 also prevents water which is flowing from top surface 8 from splashing against an adjacent kitchen wall or counter.

Figure 5:
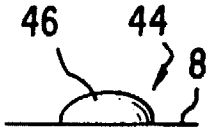
FIG. 5 is a side view of a portion of a top surface of a drying device in accordance with the present invention.
Figure 4:
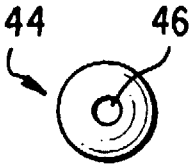
FIG. 4 is a top plan view of a portion of a top surface of a drying device in accordance with the present invention.

In light of its angled slope, it is preferred that top surface 8 be constructed such that an object placed thereon will not slide off. For example, top surface 8 may be formed in part of a sticky or "tacky" material. Preferably, however, a plurality of retaining elements are disposed upon top surface 8. In FIGS. 2, 4 and 5, retaining elements 44 comprising a plurality of raised dimples are shown. Dimples 44 are preferably formed of a plastic or rubber material. Because of their raised construction, dimples 44 retain a pan or similar object in spaced relationship to top surface 8, thereby permitting air flow and speeding the drying process. Moreover, each dimple 44 has a hole 46 formed adjacent the center thereof. A small air hole is formed adjacent the top of each dimple 44 to promote the free flow of air throughout drying device 2, while dimples 44 channel the water toward rear drainage area 20 and deter it from dripping down on to the articles drying within the interior of device 2.

Obviously, gravitational forces will urge water dripping from any objects on top of, or within, drying device 2 to flow downwardly toward the bottom portion of the device. Accordingly, the bottom portion of drying device 2 is constructed in order to capture such water, and to channel the water toward a kitchen sink or other drain.

Figure 3:
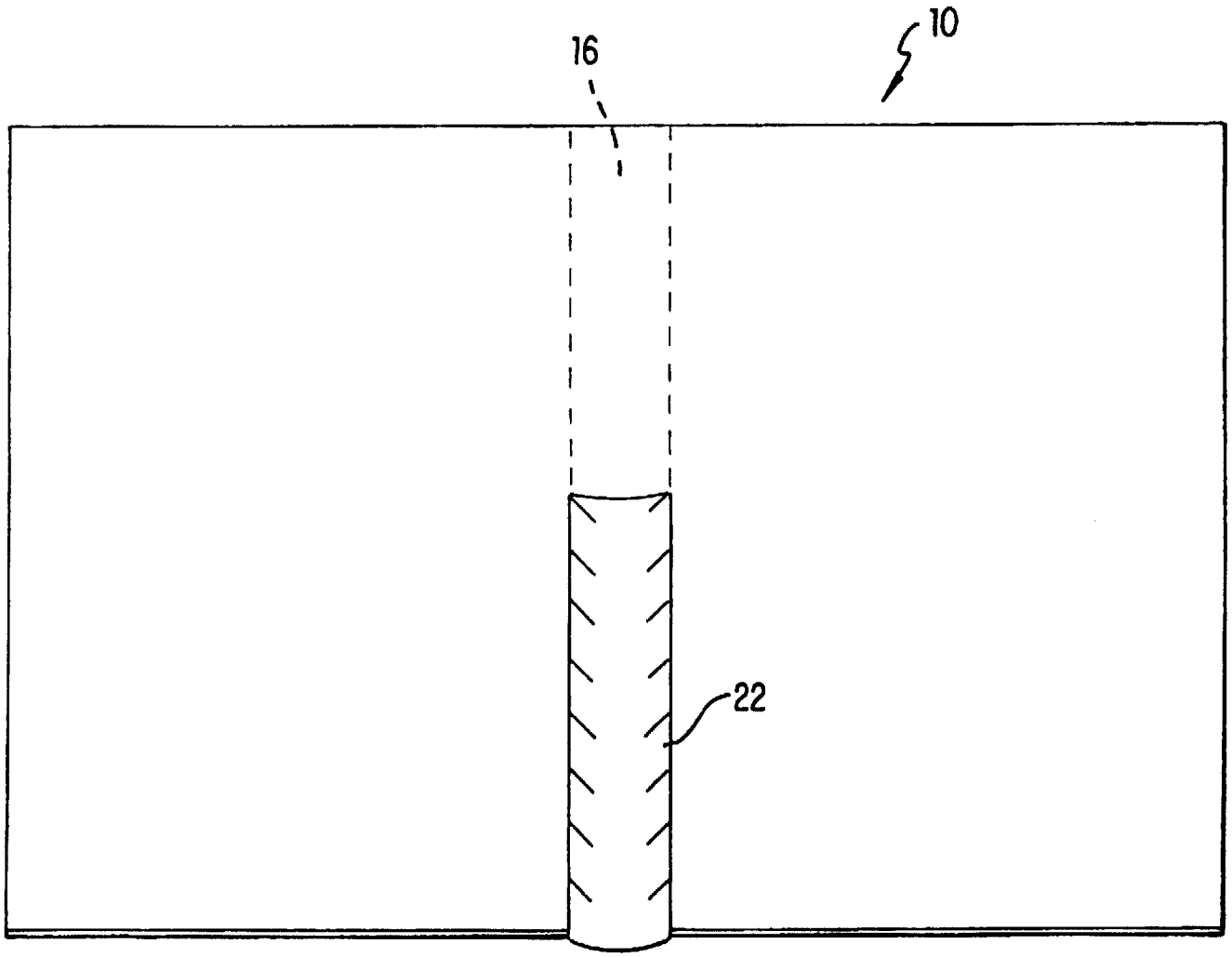
FIG. 3 is a top plan view of a bottom surface of a drying device in accordance with the present invention.

Referring to FIGS. 1–3, bearing surface 24 is disposed above bottom surface 10. Plates or other objects placed within drying device 2 through front opening 15 rest directly upon bearing surface 24. Bearing surface 24 is preferably formed at least partially of a latticed or mesh construction, such that water may readily pass therethrough. However, bearing surface 24 must also be strong enough such that it can support the weight of all the plates and other utensils resting thereon. As shown in FIG. 2, and similar to top surface 8, bearing surface 24 is slanted slightly downwardly from front opening 15 to rear wall 12. The angled slope of bearing surface 24 prevents round objects such as plates from accidentally rolling out of front opening 15.

Disposed below and offset from bearing surface 24 is bottom surface 10. Bottom surface may be folded downwardly, such as at hinge 26, for ease in cleaning. A lower drainage area 18 is defined by and comprises the area between bearing surface 24 and bottom surface 10. As shown in FIGS. 1 and 3, bottom surface 10 slopes downwardly and inwardly from each of its sides towards its center, such that bottom surface 10 has a slightly curved or "v"-type shape. This construction results in water which flows onto bottom surface 10 then being funneled toward a channel or recess 16 which is disposed adjacent with the center of bottom surface 10.

Referring to FIG. 1, bottom surface 10 may also include two extensions or wings 40 adjacent its side edges. Wings 40 may be used to capture any water which drips from utensils placed upon spikes 38 and/or within compartment(s) 28. Wings 40 may be detachable from bottom surface 10. Alternatively, as shown in FIG. 1, wings 40 may be attached to bottom surface 10 at hinges 42, such that wings 40 may be retracted when extraneous utensils are not being dried adjacent sidewalls 4,6 of drying device 2. For example, the bottom surfaces of wings 40 may include securement means such that wings 40 may be folded under and secured to bottom surface 10.

Figure 6:
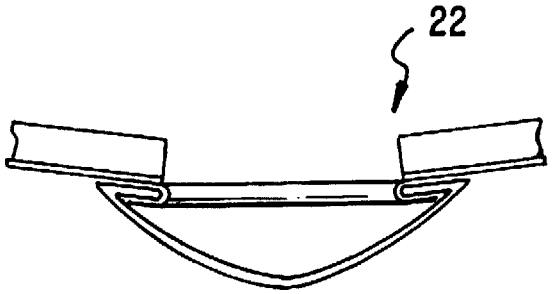
FIG. 6 is a front view of an extendable spout in accordance with the drying device of the present invention.

In addition to being angled such that water flows from its edges toward its center, bottom surface 10 also slopes downwardly from rear wall 12 toward front opening 15, as shown in FIG. 2. Accordingly, the water which flows onto bottom surface 10 and toward channel 16 is also funneled forwardly toward a spout 22 disposed adjacent the forward edge of channel 16. Spout 22 of the present invention may take the form of any number of structures, including a circular tube or a semi-circular "gutter" as shown in FIG. 3. Alternatively, as shown in FIG. 6, spout 22 may be pointed or "arrowhead" shaped.

Whatever its shape, spout 22 should be extendable from, and retractable within, drying device 2. The extendable construction of spout 22 provides the benefit of permitting drying device 2 to be placed away from a kitchen sink or other drain. In this regard, in kitchens where it is impractical to store drying device 2 near a sink, device 2 may be placed remote from the sink and extendable spout 22 may be used to funnel all water from device 2 directly into the sink. Alternatively, spout 22 may be used to funnel water into a bucket, out of a window, etc. It is preferred that spout 22 be relatively flexible, such that it may be curved or "snaked" around other objects, if necessary. Because it is also retractable, spout 22 may be stored at least partially within drying device 2 when the device is not in use, such that spout 22 does not present an aesthetic nuisance or otherwise get in the way.

Figure 7:
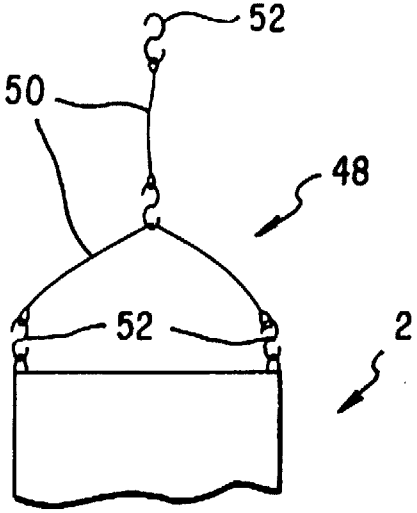
FIG. 7 is a front view of a mounting means in accordance with the drying device of the present invention.

In order that drying device 2 may be placed remote from a kitchen sink or other drain, mounting structure 36 are provided. Mounting structure 36 are shown in FIGS. 1 and 2 as comprising tabs having holes formed therein and disposed adjacent top surface 8. Any number of mounting structure may be disposed at any practical location on drying device 2. Drying device 2 may be mounted directly to any surface, such as a wall, shelf, windowsill, cabinet, etc. by placing nails, screws or similar securement means through mounting structure 36. Alternatively, a user may wish to suspend drying device 2 such that it hangs from a ceiling, kitchen cabinet, or any other load-bearing surface. As shown in FIG. 7, this may be accomplished by using second mounting structure 48. Second mounting structure 48 is shown as comprising at least one cable 50 attached to mounting structure 36, such as through the use conventional "S"-hooks 52. A single cable 50 may be used to suspend drying device 2 directly from the desired surface. Alternatively, as shown in FIG. 7, a pair of cables 50 may be used to suspend drying device 2.

Figure 8:
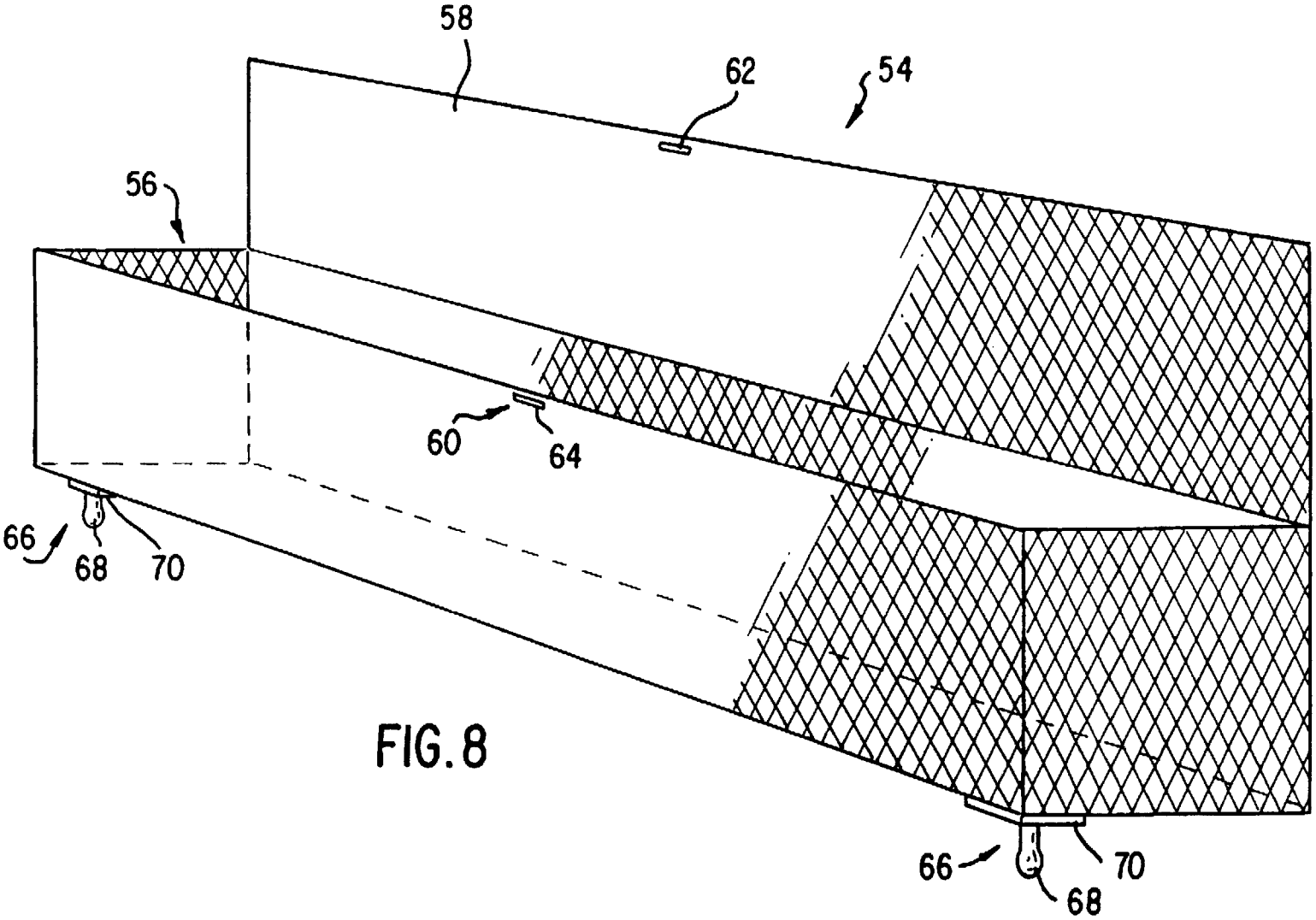
FIG. 8 is a front perspective view of a detachable knife chest in accordance with the drying device of the present invention.
Figure 10:
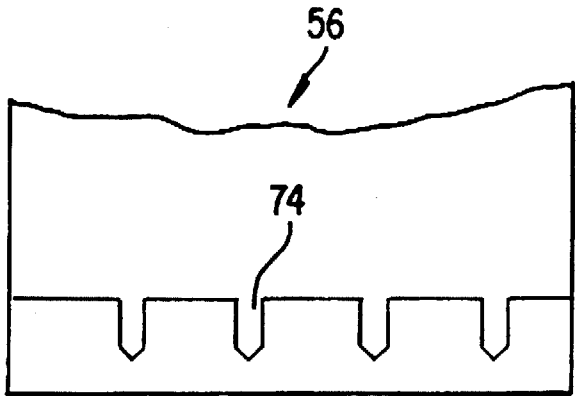
FIGS. 9 and 10 are partial top plan views of the interior of a knife chest in accordance with the drying device of the present invention.
Figure 9:
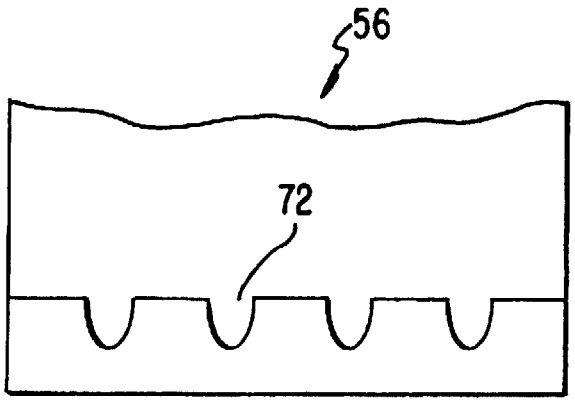

FIGS. 8–10 show a knife chest 54 which may be used in conjunction with the drying device of the present invention. Knife chest 54 is preferably formed at least in part of the same latticed or mesh construction discussed above. Knife chest 54 includes an interior compartment 56 and a lid 58. A latch 60, which may take the form of a curved projection 62 on lid 58 which mates with an aperture 64 formed within chest 54, may be used to securely close the chest.

Knife chest 54 may be detachably secured to top surface 8 of drying device 2 through the use of various attachment structure 66. As shown in FIG. 8, attachment structure 66 may comprise protrusions 68 extending downwardly from a base 70. Protrusions 68 are each snappingly received within a hole 46 of a dimple 44 disposed on top surface 8 of drying device 2. Base 70 creates a gap between drying device 2 and knife chest 54, which further promotes unimpeded water flow and air circulation.

As shown in FIGS. 9 and 10, interior compartment 56 of knife chest 54 may include recesses 72, 74 disposed adjacent the opposite ends of its bottom surface. Recesses 72 are shaped to receive handles of knives, while opposite recesses 74 are shaped to receive the corresponding knife blades. Recesses 72, 74 snugly retain knives within chest 54 and protect them from damage.

The foregoing description of the preferred embodiment has been presented for purposes of illustration and description. It is not intended to be exhaustive or to limit the invention to the precise form disclosed, and obviously many modifications and variations are possible in light of the above teachings. The preferred embodiment was chosen and described in order to best explain the principles of the present invention and its practical applications to thereby enable others skilled in the art to best utilize the invention in various embodiments and with various modifications as are suited for the particular use contemplated. It is intended that the scope of the invention be defined by the claims appended hereto.

What is claimed is:

1. A drying device comprising:

a bottom surface formed of a solid construction having sides which slope inwardly toward a center portion;

a channel disposed adjacent said center portion of said bottom surface;

an extendable and retractable spout disposed adjacent said channel;

a slanted bearing surface for supporting plates or other utensils disposed above said bottom surface, said bottom surface and said bearing surface forming a lower drainage area;

a slanted top surface formed of a solid construction disposed opposite said bottom surface;

a plurality of raised dimples disposed on said top surface;

a first sidewall joining said top and bottom surfaces and disposed substantially perpendicular thereto;

a second sidewall disposed opposite said first sidewall joining said top and bottom surfaces and disposed substantially perpendicular thereto;

a first rear wall joining said top surface, said bottom surface, said first sidewall and said second sidewall;

a second rear wall disposed behind and substantially parallel to said first rear wall, said first and second rear walls forming a rear drainage area;

a plurality of partitions disposed between and substantially parallel to said first and second sidewalls; and mounting structure for mounting said drying device remote from a kitchen sink.

2. The drying device of claim 1, wherein said bearing surface, said first sidewall, said second sidewall and said partitions are each formed partially of a latticed construction.

3. The drying device of claim 1, further comprising a knife chest formed partially of a latticed construction detachably secured to said top surface.

4. A drying device comprising:

a bottom surface having sides and a center portion;

a top surface disposed opposite said bottom surface;

a first sidewall joining said top and bottom surfaces and disposed substantially perpendicular thereto;

a second sidewall disposed opposite said first sidewall joining said top and bottom surfaces and disposed substantially perpendicular thereto;

a partition disposed between and substantially parallel to said first and second sidewalls;

an extendable and retractable spout disposed adjacent said bottom surface; and mounting structure for mounting said drying device remote from a kitchen sink.

5. The drying device of claim 4, wherein said partition is formed partially of a latticed construction.

6. The drying device of claim 4, further comprising a plurality of retaining elements disposed on said top surface.

7. The drying device of claim 6, wherein said retaining elements comprise raised dimples having holes formed therein.

8. The drying device of claim 4, further comprising a plurality of retaining spikes detachably secured to said drying device.

9. The drying device of claim 4, further comprising a silverware compartment detachably secured to said drying device.

10. The drying device of claim 4, further comprising a slanted bearing surface formed partially of a latticed construction for supporting plates and other utensils disposed above bottom surface.

11. The drying device of claim 4, further comprising a channel formed adjacent said center portion of said bottom surface, wherein said sides of said bottom surface slope inwardly toward said center portion and said spout is disposed adjacent said center portion.

12. The drying device of claim 4, further comprising a knife chest formed partially of a latticed construction detachably secured to said top surface.

13. The drying device of claim 4, further comprising hinged extensions disposed adjacent said sides of said bottom surface.

14. The drying device of claim 4, further comprising second mounting structure comprising at least one cable secured to first mounting structure.

15. The drying device of claim 4, wherein said spout is substantially semicircular or "gutter" shaped.

* * * * *